US010677407B2

(12) United States Patent
Sorg

(10) Patent No.: US 10,677,407 B2
(45) Date of Patent: Jun. 9, 2020

(54) IRRADIATION UNIT WITH PUMP RADIATION SOURCE AND CONVERSION ELEMENT

(71) Applicant: OSRAM GmbH, Munich (DE)

(72) Inventor: Joerg Sorg, Regensburg (DE)

(73) Assignee: OSRAM Beteiligungsverwaltung GmbH, Grünwald (DE)

( * ) Notice: Subject to any disclaimer, the term of this patent is extended or adjusted under 35 U.S.C. 154(b) by 0 days.

(21) Appl. No.: 16/245,267

(22) Filed: Jan. 11, 2019

(65) Prior Publication Data

US 2019/0234570 A1 Aug. 1, 2019

(30) Foreign Application Priority Data

Jan. 26, 2018 (DE) ..... 10 2018 201 236

(51) Int. Cl.
*F21S 41/176* (2018.01)
*F21S 41/16* (2018.01)
*F21Y 115/30* (2016.01)

(52) U.S. Cl.
CPC ..... *F21S 41/176* (2018.01); *F21S 41/16* (2018.01); *F21Y 2115/30* (2016.08)

(58) Field of Classification Search
None
See application file for complete search history.

(56) References Cited

U.S. PATENT DOCUMENTS

2014/0369064 A1* 12/2014 Sakaue ..... G02B 27/0994 362/553
2015/0009673 A1 1/2015 Wu et al.
2017/0334338 A1 11/2017 Schoemer et al.
2018/0058642 A1* 3/2018 Shibata ..... F21V 7/041
2018/0306425 A1 10/2018 Massmann et al.
2019/0024854 A1* 1/2019 Annen ..... F21V 7/22

FOREIGN PATENT DOCUMENTS

DE 102015220838 A1 4/2017
DE 102016208610 A1 11/2017

OTHER PUBLICATIONS

German Search Report based on application No. 10 2018 201 236.9 (9 pages) dated Nov. 5, 2018 (for reference purpose only).

* cited by examiner

*Primary Examiner* — Britt D Hanley
(74) *Attorney, Agent, or Firm* — Edward S. Podszus

(57) ABSTRACT

An irradiation unit includes a pump radiation source for the emission of pump radiation; and a conversion element for the at least partial conversion of the pump radiation to a conversion radiation. During operation of the irradiation unit, the pump radiation is incident in the form of a beam from the pump radiation source on an incidence surface of the conversion element. A first portion of the pump radiation is incident on the conversion element in a central segment of the beam and a second portion of the pump radiation is incident on the conversion element in an edge segment of the beam surrounding the central segment. The conversion element is provided in such a way that a normalized degree of conversion and/or a normalized degree of scattering is lower for the second portion of the pump radiation than for the first portion of the pump radiation.

17 Claims, 5 Drawing Sheets

IRRADIATION UNIT WITH PUMP RADIATION SOURCE AND CONVERSION ELEMENT

CROSS-REFERENCE TO RELATED APPLICATION

This application claims priority to German Patent Application Serial No. 10 2018 201 236.9, which was filed Jan. 26, 2018, and is incorporated herein by reference in its entirety.

TECHNICAL FIELD

Various embodiments relate generally to an irradiation apparatus including a pump radiation source for the emission of pump radiation and a conversion element for the at least partial conversion of same to a conversion radiation.

BACKGROUND

In the case of irradiation apparatuses of the type at issue, a conversion element, also referred to as a phosphor element, is irradiated with pump radiation, which is converted in this case to a conversion radiation of another spectral composition. The pump radiation can be, for example, blue light, wherein, in the case of a so-called partial conversion, proportionally non-converted blue light together with yellow light as conversion radiation can then be mixed to produce white light. The pump radiation source, typically a laser, and the conversion element are arranged at a distance from one another whereby an irradiation apparatus with a high radiation or light density can be realized. A more recent area of application is road illumination by way of a motor vehicle headlight, which is intended to illustrate the present subject matter but primarily is not intended to restrict the generality thereof.

SUMMARY

An irradiation unit includes a pump radiation source for the emission of pump radiation; and a conversion element for the at least partial conversion of the pump radiation to a conversion radiation. During operation of the irradiation unit, the pump radiation is incident in the form of a beam from the pump radiation source on an incidence surface of the conversion element. A first portion of the pump radiation is incident on the conversion element in a central segment of the beam and a second portion of the pump radiation is incident on the conversion element in an edge segment of the beam surrounding the central segment. The conversion element is provided in such a way that a normalized degree of conversion and/or a normalized degree of scattering is lower for the second portion of the pump radiation than for the first portion of the pump radiation.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
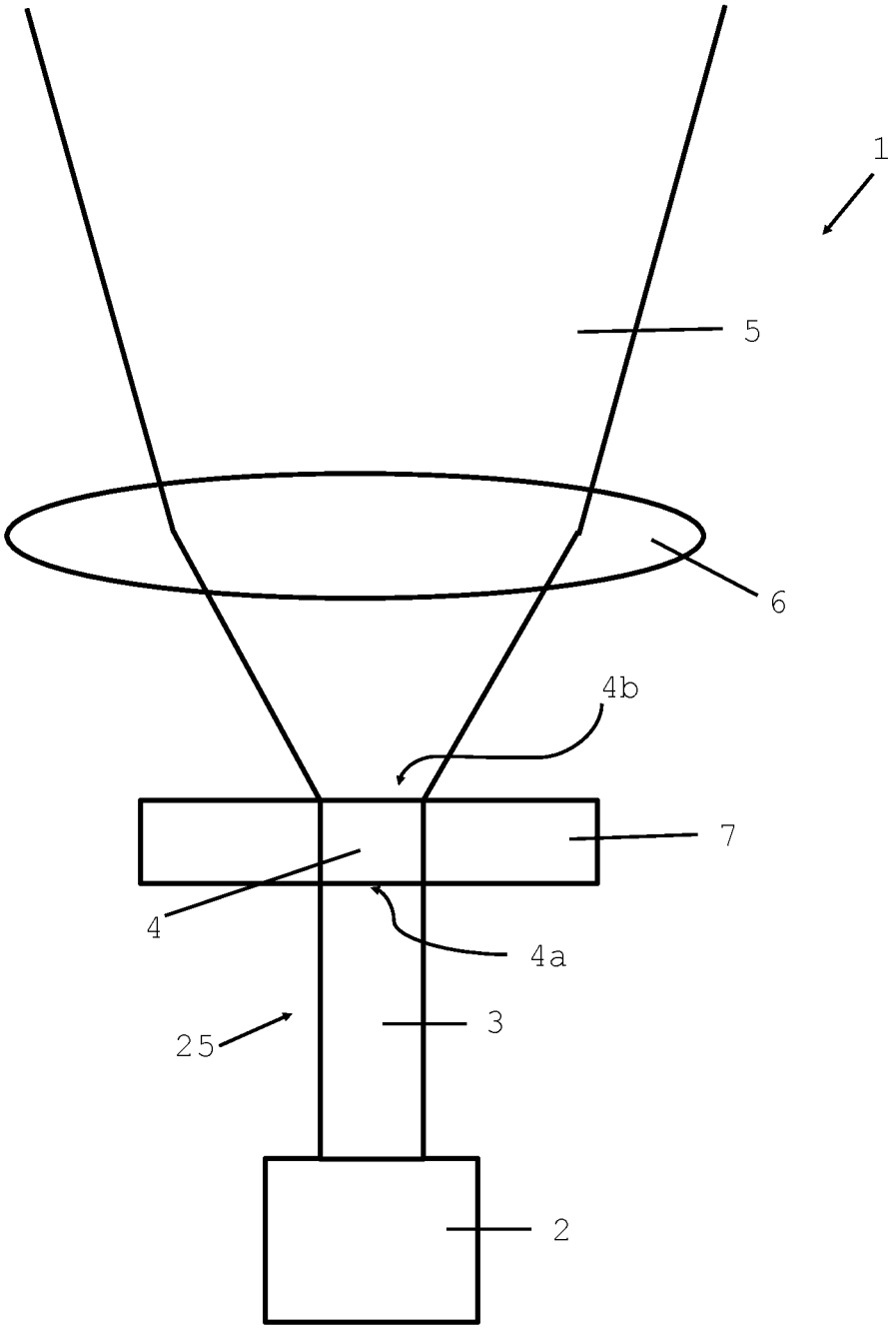
FIG. 1 shows a schematic illustration of an irradiation unit according to various embodiments.

The following detailed description refers to the accompanying drawings that show, by way of illustration, specific details and embodiments in which the invention may be practiced.

Various embodiments specify an irradiation unit.

A conversion element of an irradiation unit is not provided with a degree of conversion or degree of scattering that is constant over the extent thereof but instead at least one of said parameters varies. As a result thereof, a first portion of the pump radiation, which is guided in the pump radiation beam centrally (in a "central segment"), is converted and/or scattered proportionally more than a second portion of the pump radiation. The second portion of the pump radiation is guided in an edge segment of the pump radiation beam surrounding the central segment.

As a result, pump radiation that is incident centrally with respect to the pump radiation spot, is converted and/or scattered to a greater proportion than pump radiation that is incident at the edge. The ratio of converted to incident or of scattered to incident pump radiation is thus set to be higher in a targeted manner centrally than at the edge. This is motivated by an observation of the inventor that an inhomogeneity over the emission surface and hence ultimately on the illumination side can arise specifically in the reverse manner in the case of a conversion element with constant conversion or scattering properties.

In the case of a conversion element with a constant degree of conversion operated in transmission, the ratio of conversion radiation to proportionally non-converted pump radiation can vary, for example, over the emission surface; the result is a color locus path over the emission surface and a color locus path in the illumination light cone or illumination region, that is to say in the emission angle space. According to the invention, this is counteracted or prevented by the conversion/scattering that is more pronounced in the center because otherwise disproportionately too much pump radiation would be present in the center or disproportionately too much conversion radiation would be present at the edge. In summary, it is thus possible to counteract an inhomogeneity on the illumination side by way of the inhomogeneous or uneven configuration of the conversion element.

Various refinements are found in the dependent claims and the entire disclosure, wherein a distinction between device, method and use aspects is not always specifically drawn in the explanation of the features; the disclosure should at any rate be interpreted implicitly with regard to all claim categories. That is to say, by way of example, if an irradiation unit configured for specific operation is described, this should also be read as disclosure with respect to corresponding methods or uses, and vice versa.

The inhomogeneity depicted for the reference case of the constant degree of conversion or scattering on the illumination side results from an inhomogeneity over the emission surface. In various embodiments, a ratio of conversion to pump radiation that changes over the emission surface can be disturbing because this can then produce a color impression that is dependent on the gaze direction. The emission surface may be assigned an optical unit (see below), by way of which the inhomogeneity at the emission surface is imaged or projected into the illumination region. The optical unit can convert a spatial distribution on the emission surface to a solid angle distribution. Depending on the viewing angle, a different color impression can then be produced, that is to say a color locus path over the viewing angle. In the case of white light composed of blue pump radiation and yellow conversion radiation, there may be a yellowish impact, for example at the edge.

In general, a homogeneity that is already good over the emission surface may be provided with respect to the downstream optical unit because no or fewer precautions for mixing the illumination light are then necessary there. This can simplify the optical unit, which can provide effects in terms of cost; however, advantages with respect to the installation space can also be produced, for example, that is to say the optical unit can be built in an overall more compact manner, for example. However, degrees of freedom obtained can also be used in another way, for example, for instance to realize good contrasts (light/dark boundary). The good homogeneity already inherent to the conversion element can also offer effects in terms of efficiency. A downstream light intermixing system can namely be subject to high losses (for example in the case of a diffusing plate with scattering losses). It would likewise involve losses to "cut off" undesired or poorly intermixed regions of the illumination light cone, for instance using stops and the like.

In general, the emission surface may be assigned an imaging optical unit, even though a non-imaging optical unit is also generally possible. The imaging optical unit can assume a converging lens function, that is to say can focus the radiation output at the emission face typically in fanned-out (generally lambertian) fashion toward the illumination application. The optical unit may have a converging lens, which can further be constructed as a lens system composed of a plurality of sequentially irradiated individual lenses. The lens system or the individual lens can be embodied in an achromatic manner. The coupling-out surface of the conversion element is usually arranged in the focus of the converging lens optical unit, but can also be arranged upstream or downstream of the focal plane. As an alternative or in addition, the optical unit can also have a reflector; it can be a reflector downstream of the converging lens (e.g. at the level of a headlight).

Irrespective of the design thereof, in detail, the optical unit may image the emission surface, e.g. into infinity (a spatial distribution on the emission surface is converted to a solid angle distribution). A multi-lens array (MLA) arrangement, a facetted optical system, holographic optical elements and optical waveguides can also generally be used as lens or optical unit systems. Another conversion element with different conversion properties can also be arranged upstream of the conversion element; however, the pump radiation is preferably guided onto the (exactly one) conversion element as emitted from the pump radiation source. The useful radiation (mixture of pump and conversion radiation) of the conversion element can also be used to activate a downstream conversion element, but it may be used for illumination.

The "degree of conversion" results as a ratio of the intensity of the conversion radiation output from a specific region of the conversion element to the intensity of the pump radiation irradiated into said region. The intensity is in this case taken integrated over the angles, that is to say, for example, the conversion radiation output from said region is observed over all emission angles. The conversion can be an up-conversion or preferably a down-conversion.

Specifically, when comparing the first and the second portion of the pump radiation, the "normalized degree of conversion" is compared, that is to say the degree of conversion in the corresponding regions of the conversion element given supposedly the same intensity of the irradiated pump radiation; if the intensity or irradiance of the first and the second portion of the pump radiation were to be of the same magnitude, which it is not, proportionally less would be converted from the second portion.

The "degree of scattering", also referred to as scattering coefficient, results during operation in transmission as the ratio of the intensity of the pump radiation incident from a specific direction in a specific region of the conversion element to the intensity of the pump radiation output from said region in the same direction. In contrast to the degree of conversion, the degree of scattering is thus observed in an angle-selective manner; the scattering causes the radiation to fan out. Figuratively speaking, the degree of scattering is higher, the more radiation is distributed toward the side, that is to say the less radiation propagates along the original path. In general, the scattering or the degree or scattering relates to a redistribution of the pump radiation (without a change in the wavelength thereof) that is conversion-free in spectral terms. More specifically, the "normalized degree of scattering" is again compared, that is to say the degree of scattering given (theoretically) identical pump radiation incidence (see above).

In general, a conversion element operated in reflection is also conceivable, in which the incidence surface and the emission surface coincide. However, the conversion element may be operated in transmission, that is to say the incidence surface and the emission surface are located opposite one another. This can be provided, for example, with respect to beam guiding; pump and conversion radiation do not have to be split separately. Operation in partial conversion can therefore also be possible in a manner such that the effects mentioned at the outset (ratio of pump radiation/conversion radiation constant) particularly take effect.

The pump radiation source may be a laser source, which can also be constructed, for example, from a plurality of individual laser sources. A laser diode may be as individual laser source such that, for example, a plurality of laser diodes can then together form the pump radiation source (in general, however, a single laser diode can also be provided, of course). The beams of the individual laser sources or laser diodes can then be joined together, for example, with a beam compression optical unit and be brought in superposed fashion onto the conversion element. In general, the pump radiation upstream of the conversion element passes through e.g. air as fluid volume, wherein in general, however, an inert gas (argon etc.) would also be conceivable, for example. Such a construction is also referred to as a LARP (laser activated remote phosphor) arrangement. The pump radiation can also be guided, for example, by means of a fiber optical unit or waveguide, wherein, as an alternative to LARP, an arrangement of the conversion element directly at the output of the waveguide can then also be possible.

The conversion element may include, for example, a matrix material, for instance a ceramic, glass or else a plastic material, in which the phosphor is arranged in a manner distributed on discrete regions, for example embedded in grains of the ceramic or in particle form in the glass or the plastic (in addition, thermal filling substances or particles for better heat dissipation can also be embedded, for instance diamond, silicon, carbide). In general, however, a conversion element in monocrystalline form, for example, is also conceivable, for instance a YAG:Ce monocrystal. Furthermore, the conversion element can also be provided, for example, from agglomerated phosphor particles, which are applied, for example, in a suspension whose carrier liquid then evaporates. Functionally, the phosphor forms "conversion centers" in the conversion element; the pump radiation is converted there. It is also conceivable to produce a conversion element in a 3D printing method or an injection-molding method.

3D printing can be provided if and when a targeted configuration of the local distributions (phosphor, further filling substances, matrix material) can be possible on account of the technical degrees of freedom. Beam-limiting elements can also be imprinted concomitantly (beam confinement), for instance in the case of a phosphor region surrounded by $AlO_2$ structures. A confinement structure can be reflective or, at least in regions, translucent, and it can also have a reflection and/or translucency gradient. The confinement structure can also be embodied in a multi-part manner.

The term "phosphor" can also relate to a mixture of a plurality of individual phosphors that each emit, for example, conversion radiation with different spectral properties. Suitable phosphors can have, for example, oxidic or (oxy)nitridic materials, such as garnets, orthosilicates, nitrido(alumo)silicates, nitrido-orthosilicates or halides or halophosphates. Specific examples may include doped yttrium-aluminum garnets such as YAG:Ce, doped lutetium-aluminum garnets such as LuAG:Ce, doped silicon nitride materials such as Eu-doped $CaAlSiN_3$ or the like. Doping materials can generally be Ce, Tb, Eu, Yb, Pr, Tm and/or Sm, for example. Furthermore, additional dopings are also possible, that is to say Co dopings.

A conversion element with Cerium-doped yttrium-aluminum garnet (YAG:Ce) can be provided, e.g. with YAG:Ce as single phosphor. In the case of a partial conversion, white light can then be produced by way of the yellow conversion radiation of said conversion element when mixed with proportionally non-converted blue pump radiation. Irrespective of the phosphor, for example, the conversion element can e.g. also have scattering centers. In this case, for example, these may be deliberately introduced damaged locations in the matrix material. Scattering can take place, for example, at air pores included in the material (a ceramic can also be sintered accordingly, with a residual porosity, by way of which the path length of the light is increased). Scattering particles and air inclusions can interact. Also in the case of phosphor, porous regions (air inclusions) can be introduced in a targeted manner into glass (highly viscous), said porous regions e.g. being able to be scattering particles, for instance titanium dioxide particles. If, for example, glass is provided as the matrix material, in addition to the phosphor (and possibly the scattering particles), heat-conducting particles, for example, can also be embedded, for instance composed of diamond, sapphire and/or silicon carbide. Of course, the same particles can also assume a heat-conducting and scattering function at the same time.

The variation of the degree of conversion or scattering can be achieved in different ways, which is discussed in detail below. In accordance with a first variant, the incidence surface and the emission surface of the conversion element can be of different sizes, for example, that is to say the conversion element can have a cone shape, for example, which means a lower effectively irradiated thickness for the pump radiation at the edge. In accordance with a further variant, the incidence surface and/or the emission surface can be curved in such a way that the conversion element is thicker in the center. In both variants, a larger thickness means more effectively irradiated conversion and scattering centers and a smaller thickness means fewer (said conversion and scattering centers then also being able to be provided with a constant density). In accordance with a further variant, the density of the conversion and scattering centers can be adjusted, namely can be higher in the center than at the edge. The mentioned possibilities can be provided alternatively to one another or also in combination with one another.

In general, a conversion element in which both the degree of conversion and the degree of scattering varies can be provided. However, this is generally not compulsory; it is likewise also possible for precisely just one of the parameters to vary, which is then e.g. the degree of conversion. Insofar as mention is generally made, for example, of the fact that there is proportionally more conversion or scattering in the center than at the edge, this relates to a comparative situation in which irradiation takes place sequentially once only locally in the center and once only locally at the edge. During normal operation, that is to say when irradiation takes place in the center and at the edge simultaneously, the inhomogeneous degree of conversion or scattering then produces precisely one instance of homogenization.

In various embodiments, the degree of conversion and/or the degree of scattering decreases for the second portion of the pump radiation with a continuous profile toward the outside, that is to say the decrease is free of sudden changes (no step function etc.). A smooth profile is preferred, that is to say, from a mathematical point of view, a differentiability is provided over the entire region. The decrease in the degree of conversion or scattering that is constant in the edge region for the second portion of the pump radiation can, on the one hand, be combined with a, for the first portion, centrally constant degree of conversion or scattering. On the other hand, however, the degree of conversion or scattering can also decrease outwardly as early as in the central region, that is to say, for example, overall can have a bell-shaped profile, for instance in a Gaussian manner. In general, the decrease that is continuous toward the edge can be provided in terms of a particularly good homogenization.

For the second portion of the pump radiation, however, the degree of conversion and/or scattering can change toward the outside with a non-continuous profile so that, from a mathematical point of view, the corresponding function can contain sudden changes (mathematical step function).

Insofar as reference is generally made in the context of this disclosure to an extent "outwardly", this relates, unless otherwise indicated, to directions perpendicular to the central ray of the pump radiation beam and pointing away from said central ray. The central ray lies parallel to the main direction of the beam, in the center thereof. The main direction results as a centroid direction of all direction vectors along which the respectively observed radiation propagates in the respective section, wherein each direction vector is weighted with the radiant intensity associated therewith during this averaging.

In various embodiments relating to operation in partial conversion, the illumination light output at the emission surface has a constant color locus over the emission surface. In other words, that is to say the ratio of the output conversion radiation to the non-converted, likewise output, pump radiation is constant over the emission surface, in any case in the context of routine technical accuracy. The color locus can be observed, for example, in a CIE standard chromaticity diagram (1931); the illumination light then has a $c_x$ and a $c_y$ value in the colour shoe, wherein said value pair is constant over the emission surface.

The illumination light can e.g. be white light. As observed in the CIE standard chromaticity diagram (1931), the color locus of the white light should be spaced, for example, by not more than 15 threshold value units from the Planckian locus, with increasing preference in the order mentioned of not more than 14, 13, 12, 11 or 10 threshold value units (each in terms of absolute value). A threshold value unit (SWE) is defined as $SWE=((u'_2-u'_1)^2\cdot(v'_2-v'_1)^2)^{1/2}$, and specifically in the normalized u'(v') space, which results due to transformation from the $c_x/c_y$ space of the standard chromaticity diagram.

In various embodiments relating to a conversion element operated in transmission, the incidence surface and the emission surface are of different sizes. The incidence surface may be smaller than the emission surface, or vice versa. Beam guidance in such a way that the smaller of the two surfaces is irradiated only by the central segment of the beam, that is to say the edge segment externally passes by said smaller surface, may then be provided.

For illustration, the conversion element can have, for example, the shape of a truncated cone; said truncated cone is then located in the pump radiation beam in such a way that both the smaller top surface of the truncated cone and the larger base surface thereof are each irradiated fully with pump radiation; that portion of the pump radiation then passing through only the base surface is the second portion; the central portion passing through both the base and the top surface is the first portion. This example illustrates that a degree of conversion or scattering that decreases toward the outside can be set for the second portion of the pump radiation in this way. The second portion of the pump radiation enters and exits at the oblique lateral surface of the truncated cone; the effectively irradiated conversion element volume decreases toward the outside.

Although a conversion element in the shape of a truncated cone may be preferred, the effect just mentioned can also be achieved using more complex shapes. The lateral surface thus does not necessarily have to extend in a linear manner in section. Although a rotationally symmetrical lateral surface may be provided, it is likewise generally not compulsory. In general, the thickness of the conversion element is taken between the incidence surface and the emission surface, perpendicular to the width thereof. Said width increases from the smaller to the larger surface preferably with a continuous profile.

In general, in the present case, the entire corresponding side surface of the conversion element is considered as the incidence surface and emission surface respectively, which side surface can be either entirely irradiated with pump radiation or can emit conversion radiation specifically depending on the embodiment, or else in the case of a smaller pump radiation spot can also be irradiated or can emit only in a partial region. In various embodiments, at least one of the two surfaces is planar, e.g. both surfaces are planar and parallel to one another, particularly in the case of the embodiment with different sized incidence surface and emission surface (or insofar as the variant with "curved incidence surface/emission surface" is not involved, see below).

In various embodiments, a surface ratio resulting as a surface area of the smaller of the two surfaces to the surface area of the larger is at least 1:5. A lower limit of 2:5 may be further provided, 1:2 being exemplarily provided. Exemplary upper limits of the surface ratio, which may generally also be of interest independently of the lower limits and which are intended to be disclosed (which also applies conversely), are with increasing preference in the order mentioned at most 9:10, 4:5 or 7:10.

Absolute values may depend on various factors, for instance the properties of an optical device between the pump radiation source and the incidence surface (such as, for example, a collimation lens, etc.), the thermal load-bearing capacity of the conversion element, the desired size of the emission at the emission surface etc. The pump radiation spot can have, for example, a size of a few micrometers, for example at least 10 μm, 20 μm, 30 μm, 40 μm or 50 μm. Upper limits independent thereof can lie in the millimeter range, but also below it, for example at most 800 μm, 600 μm or 400 μm. The same size ranges are also intended to be disclosed for the incidence surface and the emission surface. The thickness of the conversion element can also depend on various factors; for example, at least 100 μm or 200 μm as lower limits are typical, with possible upper limits (independent thereof) in the millimeter range, or else below it, for instance at most 800 μm or 600 μm.

In various embodiments, the conversion element, whose incidence surface and emission surface are of different sizes, has, in section, a trapezoidal shape, e.g. the shape of an isosceles trapezoid. In the case of a rotationally symmetrical refinement, the truncated cone discussed above thus arises. Although preferred, such rotational symmetry is conversely not compulsory; as seen along the central ray, the incidence surface and the emission surface can also have, for example, a rectangular, e.g. quadratic, or else a more complex shape (hexagonal etc.). A plurality of individual laser sources can also be provided, for example, in a distributed manner circulating around the central ray (see above), which can then produce, for example, a rosette-shaped spot.

In various embodiments, which may also be of interest independently of the variation of the degree of conversion and scattering in accordance with the main claim and which is intended to be disclosed, the pump radiation fills the entire incidence surface of the conversion element during operation. The pump radiation spot, the extent of which is generally taken based on the irradiance distribution according to the full width at half maximum (alternatively a decrease to $1/e^2$ could also be considered), on the one hand, can thus be exactly the same size as the incidence surface and can therefore be congruent. However, on the other hand, the pump radiation spot can even also be (somewhat) larger. The profile of the irradiance distribution does not necessarily have to be Gaussian (even though this is preferred); said profile can also be formed by means of optical units downstream of the pump radiation source, for example can have a Lorentzian profile. The pump radiation can be incident on the phosphor in a convergent, divergent, or parallelized or polarized manner.

The inventor has determined that also even an incidence surface irradiated entirely with pump radiation can help to prevent the problem of the surface-dependent or solid-angle-dependent color locus path discussed at the outset. The ratio of conversion radiation to proportionally non-converted pump radiation can thus also be kept substantially constant at the edge. Even though this variant may also be of interest irrespective of the variation of the degree of conversion or scattering, a combination with other presently disclosed features may be provided nonetheless (such as, for example, operation in transmission, partial conversion, state of the conversion element, etc.). A combination of these variants with the varying degree of conversion or scattering can also be provided.

In various embodiments, the conversion element is thicker in a central region through which the central segment of the beam passes than in an edge region that surrounds the central region e.g. in an annular manner.

In various embodiments relating to a conversion element operated in transmission, the incidence surface or the emission surface is planar and the respective other surface is convexly curved. That is to say the incidence surface can be planar and the emission surface can be convexly curved, or vice versa. As a result of the convex curvature, the conversion element is thicker in the center than at the edge such that more conversion or scattering centers are passed through in the center.

In various embodiments, the density of conversion and/or scattering centers is higher in a central region of the conversion element than in an edge region such that there is proportionally more conversion or scattering in the center. In this variant, the conversion element can also have a simple geometric outer shape, that is to say, for example, the incidence surface and the emission surface can each individually be planar, that is to say the conversion element overall can be kept, for example, in disk or lamellar shape. In general, however, a combination with one or more of the geometric variations depicted above is of course also possible.

The varying density can be achieved, for example, by virtue of more conversion particles and/or scattering particles being embedded into a matrix material (for example plastic or glass or a ceramic, see above) in the center than at the edge. In this case, the matrix material between the central and edge region can generally also be formed continuously, that is to say, in a matrix material that is monolithic per se, more conversion or scattering particles can be incorporated in the center than at the edge. The degree of conversion or scattering can then also have, for example, a constant profile, that is to say can decrease with a smooth function from the center to the edge (see above).

In various embodiments, in this variant, a stepped profile can be provided, however. The density is thus higher in the central region than in the edge region, but in each case is constant over the respective region. The edge region can then surround the central region like a ring or a sleeve. Of course, overall there can then also be a plurality of rings or sleeves nested inside one another here, wherein the density is constant for each sleeve but decreases toward the outside from sleeve to sleeve. As seen in the direction of the irradiation, the sleeves do not necessarily have to be annular; angular or other shapes are likewise conceivable, even though a circle is preferred. The annular segment rings can have the same or different diameters (thickness regions) among one another. Staggering of the diameters is also possible.

In general, the stepped variant can be advantageous in terms of production of the conversion element. The individual regions can then each individually be produced and then assembled with their corresponding density of conversion or scattering centers. The regions can e.g. be joined together, for example adhesively bonded (for instance using a glass adhesive) or pressed. In contrast to the conversion element depicted above, the matrix material is then not monolithic, but interrupted (assembled in multiple parts).

A conversion element segmented accordingly into a plurality of regions, that is to say assembled from a plurality of conversion element parts produced individually, that is to say embodied in multipartite fashion, can also be of interest in the case of one of the variants depicted above. Thus, for example, the conversion element with different sized incidence surface and emission surface, which element can preferably in section be trapezoidal or cone-shaped overall, can be constructed from a plurality of parts. For example, a central region could be conical, wherein one or more cone shells can then be placed at said central region so that the truncated cone results. An analogous procedure is also conceivable in the other variants, namely the modularity may be of interest, for example, in terms of manufacturing, because different conversion elements can be constructed using some conversion element parts as basic modules where necessary.

In various embodiments, the conversion element is provided with an electrode. Said electrode can be provided as metallic (for example composed of tungsten particles) or else as transparent, for instance composed of indium tin oxide (ITO). Said electrode can be arranged, for example, at the incidence surface or the emission surface; said electrode is preferably embedded into the conversion element (see below). The electrically conductive electrodes can also be incorporated into the material in a targeted manner by means of a 3D printing method, that is to say run not only at material surfaces or boundary surfaces, but also in the material volume itself.

Irrespective of its application or state, for example, the electrode can make it possible to monitor the conversion element. That is to say, it is possible to check or monitor the mechanical integrity of the conversion element using a resistive measurement, for example, but alternatively or in addition also using a capacitive or inductive measurement. During operation, mechanical loading can occur on account of the high power densities on the one hand but also given external boundary conditions (change in temperature or vibrations etc., e.g. in motor vehicle applications). The conversion element can crack or break or else completely fall off a carrier, which can constitute a significant photobiological risk for illumination.

Non-converted or unscattered, that is to say focused/collimated and/or coherent, pump radiation could then attain the illumination application, which, for an observer there, can result, for example, in damage to the retina and, in the worst case, loss of vision. The electrode can now make possible certain monitoring or checking; in the case of degradation or destruction of the conversion element, the electrode is generally also damaged/destroyed, or, in the case of the conversion element simply falling off, it is no longer present, which can be detected metrologically. For example, dimming or else complete switch-off of the pump radiation source can then be prompted.

As mentioned, an electrode embedded into the conversion element may be provided. This can be implemented, for example, in the case of a conversion element assembled from conversion element parts. To this end, for example, one of the conversion element parts can be provided with the electrode at a side surface, which is then brought together with another conversion element part. For example, the central truncated cone can thus be furnished at the lateral surface thereof with the electrode, said electrode being able, for example, to be vapor-deposited or to be applied using other methods known from microelectronics. The electrode can be implemented over the whole surface or else only over part of the surface, for example in a strip-like manner. Each of the conversion element parts can have its own monitoring layer, e.g. in a strip-like manner, wherein the strips can then be arranged so that they are offset at an angle to one another, that is to say they do not overlap in the angle space at all or only overlap in regions.

In various embodiments, the conversion element is arranged in a partially radiation-transmissive but at the same time radiation-scattering carrier. A corresponding carrier can be provided, for example, from a ceramic material, for instance based on aluminum oxide. In this case, the ratio of transmittivity to scattering can also be set by setting the grain sizes and/or material porosity etc. Based on the visible spectral range, the carrier may be translucent (permeable to light but not permeable to sight).

Said carrier outwardly encloses the conversion element, said carrier e.g. releasing the incidence surface or emission surface in the process, e.g. both surfaces. A carrier of this kind can be combined with a conversion element depicted above having different sized incidence surface and emission surface. Said carrier can then enclose the oblique side surfaces of the trapezoid or cone shape outwardly, that is to say to the side.

The provision of a scattering carrier can provide an effect in terms of efficiency, for example, in comparison to a transparent, that is to say see-through, carrier because radiation that is laterally incident in the carrier is also always scattered back in the direction of the conversion element proportionally and is scattered there with a certain degree of likelihood "forward", that is to say in the optical used direction or main emission direction. This can relate to conversion radiation emerging at the side but also to pump radiation scattered to the side in the conversion element. As an alternative, a corresponding beam guidance forward can be achieved, for example, also by way of reflective coating, for example reflective coating with heat-conducting silver and/or gold and/or with aluminum, on the side wall of the conversion element. The reveal in the carrier and/or the conversion element itself could thus be provided laterally with a reflective coating, for example with a metal layer. In this case, a transparent carrier could then also be provided.

For example in the case of the conversion element with different sized incidence surface and emission surface, however, the radiation-transmissive but scattering carrier may be preferred because, in this case, providing the side wall with a reflective coating in this way is hardly or not possible. For example, if the side wall of the trapezoidal or frustoconical conversion element were provided with a reflective coating, said side wall could either simply not be irradiated (which, however, is necessary, see above) or there would be demixing in the case of providing a reflective coating in a manner dependent on wavelength.

In various embodiments, a side surface of the carrier extending parallel to the incidence surface and/or the emission surface of the conversion element is provided with a radiation-impermeable mask. In various embodiments, the incidence surface and/or the emission surface of the conversion element and said side surface of the carrier can lie in a common plane. The mask forms a stop, which passes through the beam. Said mask masks the beam; if said beam were (theoretically) to propagate without interaction through the conversion element, it would pass precisely through the stop formed by the mask. Such a (theoretically undisturbed) beam is thus neither significantly trimmed by the mask nor is it guided therein "with play"; e.g. it fills the stop exactly.

In the case of the conversion element with different sized incidence surface and emission surface, the masking system can e.g. be provided in such a way that the stop corresponds to the larger of the two surfaces. A design can be particularly preferred to the extent that, in the case of a conversion element operated in transmission, the emission surface is smaller than the incidence surface, wherein the mask is then arranged at the emission surface, cf. also the exemplary embodiment for illustration. A mask arranged at the emission surface or the corresponding side surface of the carrier can generally be provided. Irrespective of the advantages thereof with respect to beam forming etc., the mask can (additionally) be used, for example, to monitor the conversion element too. Said mask can be coupled, for example, to an electrode, depicted above, of the conversion element, for instance in an inductive or capacitive manner, and can serve for detecting damage.

Reference has already been made above repeatedly to the shape of the conversion element as seen in the irradiation direction. Even though angular shapes are also generally possible, a conversion element constructed so as to be rotationally symmetrical can also be generally preferred. An axis of rotational symmetry then e.g. lies parallel to the main direction of the incident beam; the central ray thereof can e.g. coincide with the axis of rotation.

Various embodiments also relate to the use of an irradiation apparatus disclosed in the present case for illumination, e.g. for motor vehicle illumination, e.g. for motor vehicle exterior illumination, preferably in a headlight. The motor vehicle may be an automobile. The irradiation apparatus is used to provide a light source of high light density, which can form or support high beam but also low beam, for example. The irradiation apparatus may be used for a static light function, for example as high beam or additional high beam.

Further fields of application can be, for example, lighting modules for video projection or cinema projection applications, as well as spotlights for effect lighting, entertainment lighting, architainment lighting, general lighting, medical and therapeutic lighting or lighting for gardening, in particular also horticulture.

FIG. 1 shows an irradiation unit 1 according to various embodiments including a pump radiation source 2, a laser, for the emission of pump radiation 3 and a conversion element 4 for the partial conversion of the pump radiation 3 to a conversion radiation 5. The conversion element 4 is operated in transmission; an incidence surface 4*a* on which the pump radiation 3 is incident is located opposite an emission surface 4*b*.

The conversion radiation is typically output at the emission surface 4*b* in a lambertian manner. Furthermore, proportionally non-converted pump radiation is also output there, which is not illustrated in detail for the sake of clarity, however. The pump radiation 3 is incident on the incidence surface 4*a* in a collimated or focused manner, wherein the non-converted proportion downstream of the conversion element 4 is then fanned out in a manner comparable to the conversion radiation 5 on account of scattering processes in the conversion element 4. The emission surface 4*b* is assigned an optical unit 6, in the present case illustrated in a simplified manner as a individual converging lens. Radiation output at different locations of the emission surface 4*b* is guided in different spatial directions by way of the optical unit 6 (not illustrated in detail).

The pump radiation 3 can be, for example, blue laser light, which can then be converted to yellow light as conversion radiation by way of a YAG:Ce phosphor, that is to say by way of Cerium-doped yttrium-aluminum garnet. In the case of the partial conversion illustrated, proportionally blue pump radiation also remains so that, when mixed with the yellow light, white light is produced. This can be used for illumination, for instance in a motor vehicle headlight.

As discussed in detail in the introduction of the description, in the case of a conversion element 4 with constant conversion or scattering properties according to the prior art, in which the incidence surface 4*a* and the emission surface 4*b* are also each significantly larger than a pump radiation spot, an inhomogeneity can be produced on the emission side. In an outer or edge region, disproportionately too much conversion radiation 5 is then present; therefore the white light output there then has a yellow tinge. In the conversion element 4 according to various embodiments, the degree of conversion or scattering is therefore adjusted in such a way that there is comparatively more conversion or more pronounced scattering in the center.

Figure 2A:
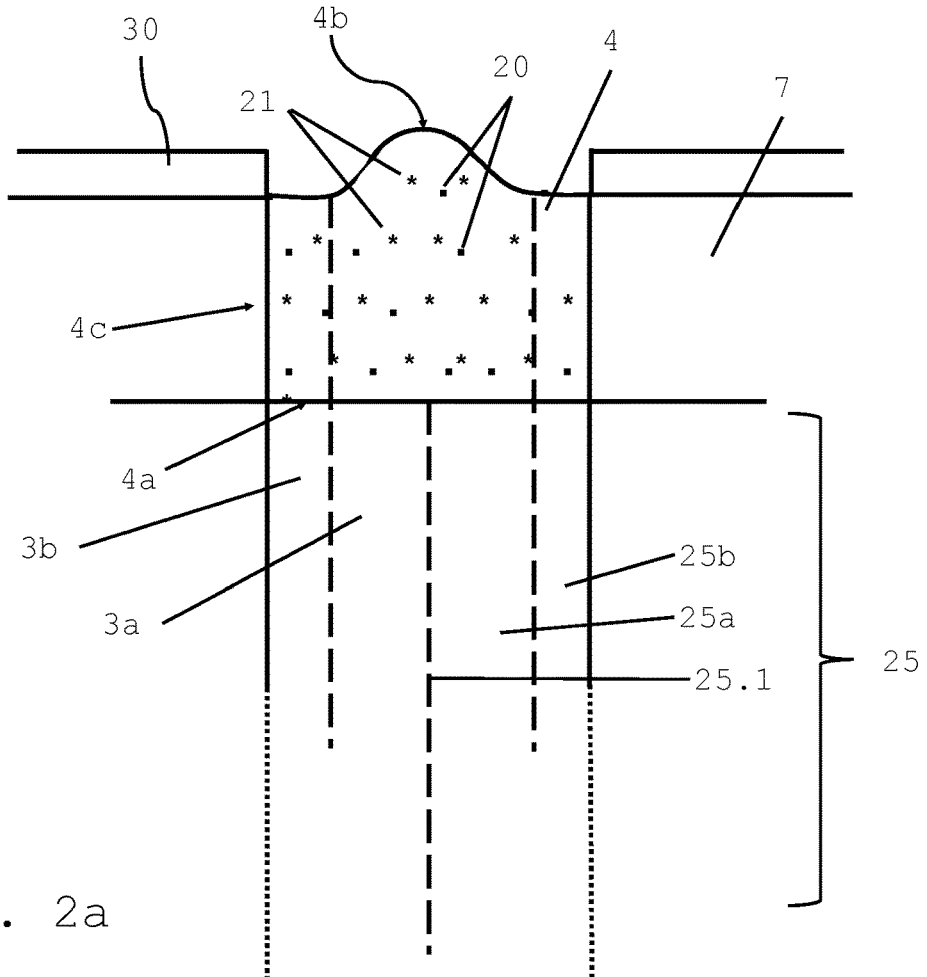
FIG. 2*a* shows a first possibility for designing a conversion element according to various embodiments for an irradiation unit as per FIG. 1.

FIG. 2*a* shows a first possibility of configuring a corresponding conversion element 4. The conversion element 4 has conversion centers 20 embedded in a matrix material, for example YAG:Ce particles, and scattering centers 21, for example titanium dioxide particles and/or air inclusions (porous regions). In this variant, the conversion and scattering centers 20, 21 are distributed with a constant density over the conversion element 4; the varying degree of conversion or scattering is achieved geometrically.

The emission surface 4*b* is convexly curved such that the conversion element 4 is thicker, as seen in the direction of the irradiation, in the center than at the edge. The pump radiation 3 is incident in the form of a beam 25 on the incidence surface 4*a*. In this case, a first portion 3*a* of the pump radiation 3 is guided in a central segment 25*a* of the beam 25. A second portion 3*b* of the pump radiation 3 is guided in an edge segment 25*b* surrounding said central segment 25*a*. For the first portion 3*a* of the pump radiation 3, on account of the locally thicker conversion element 4, more conversion and scattering centers 20, 21 are arranged in the beam path. Accordingly, proportionally more is converted and scattered from the first portion 3*a* than from the second portion 3*b*.

Figure 2B:
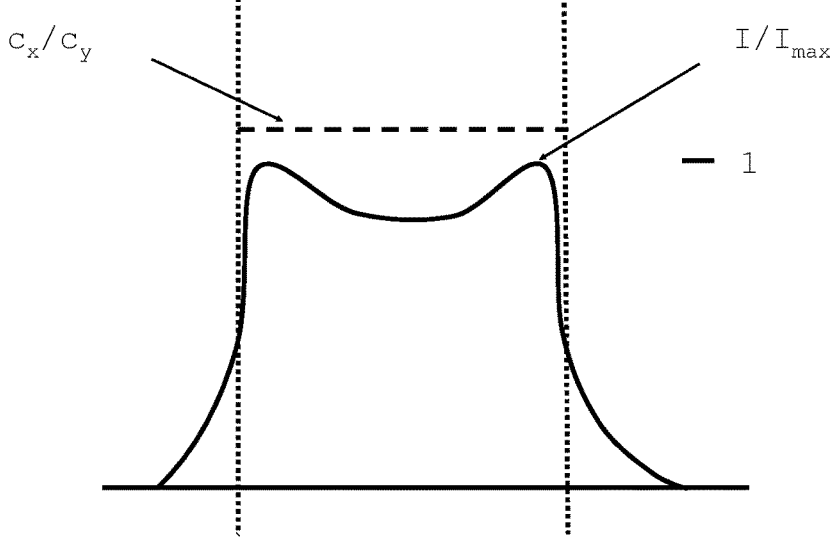
FIG. 2*b* shows the profile of color locus and intensity for the conversion element as per FIG. 2*a;*

As can be seen from FIG. 2*b*, this produces as a result a color locus that is constant over the emission surface 4*b* (the quotient $c_x/c_y$ relates to a value pair in a CIE standard colorimetric system). The dashed line relates to this axis, that is to say the color locus, which is constant. The intensity is also plotted in the graph, normalized to the maximum intensity (solid line, relates to the right Y axis).

As can further be seen from FIG. 2*a*, the conversion element 4 is enclosed to the side by a carrier 7 (also illustrated in FIG. 1). Said carrier is provided from a ceramic based on aluminum oxide; said carrier is radiation-transmissive but scattering (translucent). The conversion or pump radiation emerging at the side wall or walls 4*c* of the conversion element 4 is proportionally scattered back into the conversion element 4, and can be scattered there (again proportionally) forward.

The frontal side face of the carrier 7, said side face being arranged at the emission surface 4*b*, is furthermore provided with a masking system 30 so that a clean, delimited spot is produced on the emission side.

Figure 3A:
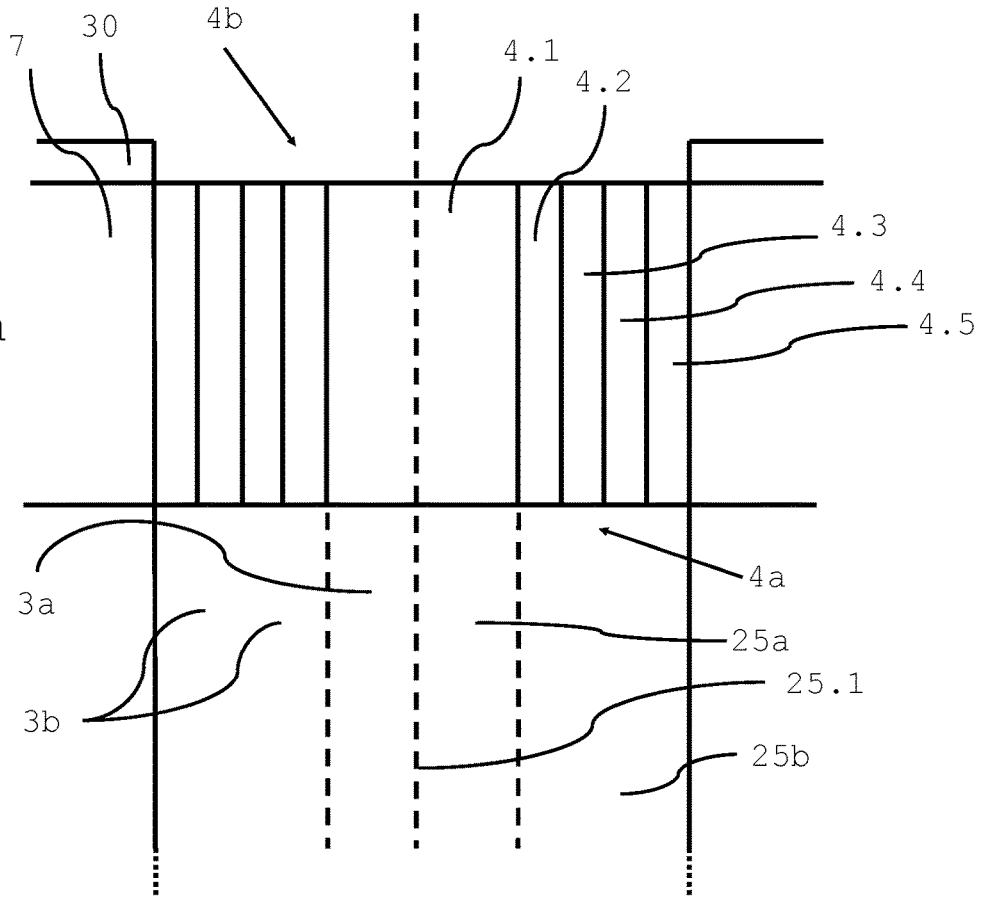
FIG. 3*a* shows a second possibility for configuring a conversion element according to various embodiments for an irradiation unit as per FIG. 1.

FIG. 3*a* shows a further possibility for configuring a conversion element 4 with a varying degree of conversion or scattering. In general, in the context of this disclosure, the same reference signs denote the same parts or parts with the same function and in this respect reference is also always made to the description with regard to the respective other figures.

The conversion element 4 as per FIG. 3*a* is composed of a plurality of conversion element parts 4.1 to 4.5. In each of the conversion element parts 4.1 to 4.5, the density of conversion and scattering centers (not shown here for the sake of clarity) is constant in each case; however, the density does decrease from part to part toward the outside. Said density is accordingly highest in the conversion element part 4.1 and is lowest in the conversion element part 4.5 (stepped accordingly in the other parts).

The first portion 3*a* of the pump radiation 3 is incident on the conversion element part 4.1 and is converted or scattered to the greatest extent. There is further differentiation within the second portion 3*b* of the pump radiation 3, according to the conversion element parts 4.2 to 4.5. Overall, a stepped but nevertheless as a result sufficiently gentle profile of the degree of conversion or scattering is produced thereby.

Figure 3B:
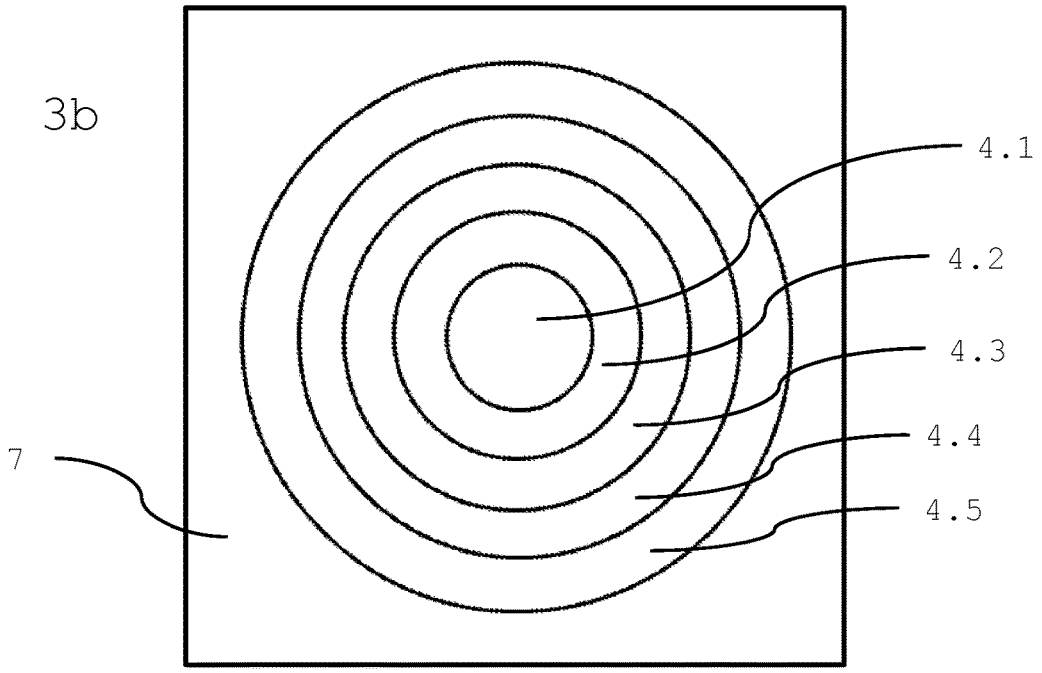
FIG. 3*b* shows a top view of the conversion element as per FIG. 3*a;*

FIG. 3*b* shows a top view of the conversion element 4 as per FIG. 3*a*; the individual conversion element parts 4.1 to 4.5 are arranged concentrically in a circular or annular shape. Furthermore, the carrier 7 can also be identified, said carrier being able to be formed so as to be scattering, as in the case of the variant as per FIG. 2 for the at least partial return of radiation. However, it is likewise also possible to provide a reflective coating on the side wall 4*c* of the conversion element or the associated surface of the carrier 7 (not illustrated in detail).

Figure 5:
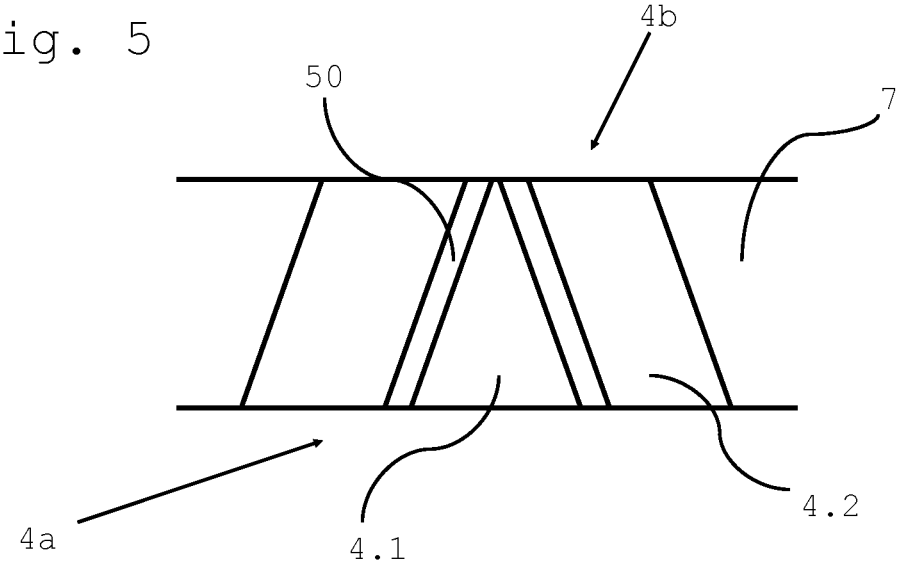
FIG. 5 shows a possibility for supplementing the conversion element as per FIG. 4*a* with an electrode.

Transparent electrodes composed of ITO can be arranged between the conversion element parts 4.1 to 4.5 (not illustrated here, see FIG. 5 in this respect). Said electrodes can be measured in a resistive or capacitive or inductive manner (not illustrated in detail), which permits monitoring of the conversion element 4. If there is a failure or other damage, as a rule, the electrode is also damaged, which can be detected metrologically. The pump radiation source 2 can then be switched off or dimmed, which reduces a photobiological risk.

Figure 4A:
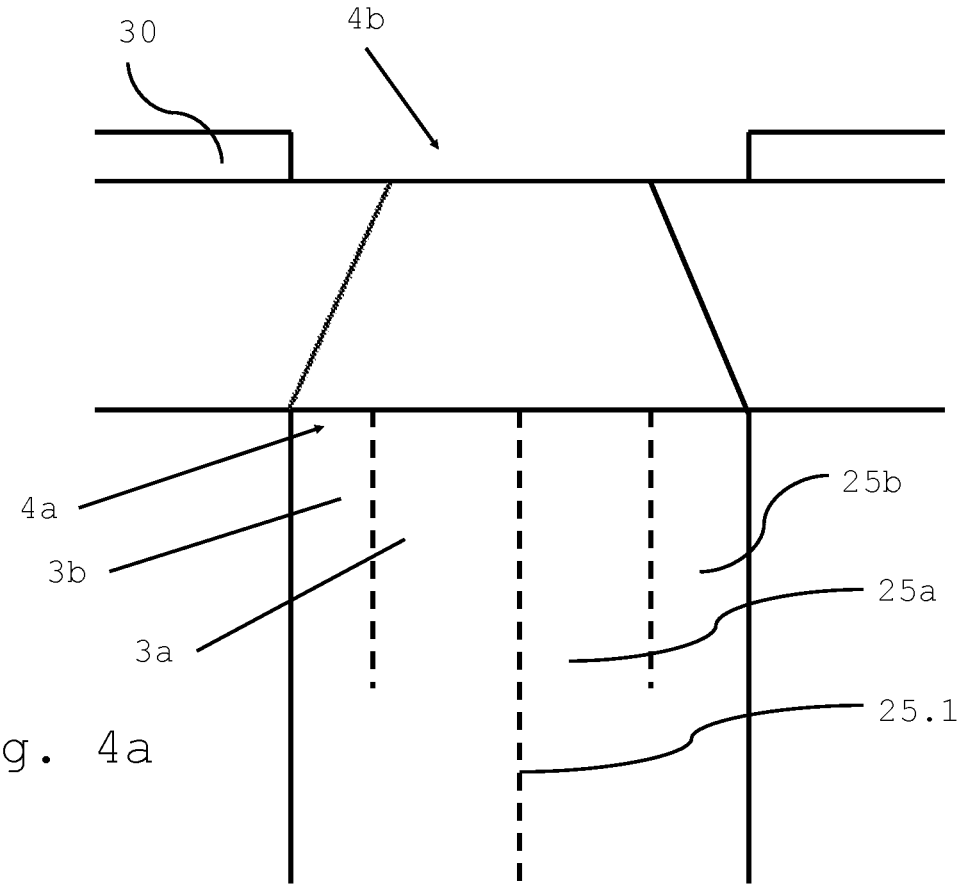
FIG. 4*a* shows a third possibility for configuring a conversion element according to various embodiments for an irradiation unit as per FIG. 1.

FIG. 4*a* shows a further possibility for configuring a conversion element 4 with a varying degree of conversion and scattering. Analogously to the variant as per FIG. 2, the density of conversion and scattering centers is constant here. The variation is again achieved geometrically. The conversion element 4 is trapezoidal, as seen in a sectional plane containing the central ray 25.1 of the beam 25. Overall, in the present case, said conversion element is rotationally symmetrical around the central ray 25.1, that is to say has the shape of a truncated cone. The incidence surface 4*a* is larger than the emission surface 4*b*.

The pump radiation 3 fills the entire incidence surface 4*a*; although the second portion 3*b* of the pump radiation accordingly enters at the incidence surface 4*a*, it does not exit at the emission surface 4*b*. Instead, the second portion 3*b* exits at the oblique side surface 4*c*, that is to say, for the second portion 3*b*, the effectively irradiated thickness decreases toward the outside. Accordingly, the pump radiation "sees" less conversion and scattering centers there, that is to say there is proportionally less conversion and scattering.

Figure 4B:
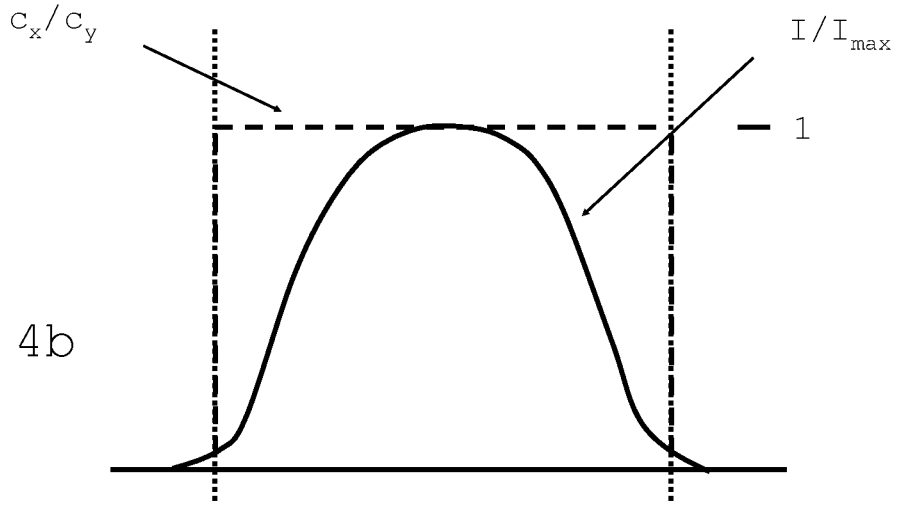
FIG. 4*b* shows the profile of color locus and intensity for the conversion element as per FIG. 4*a;*

This in turn produces a constant ratio of the color locus coordinates $c_x/c_y$, cf. the dashed line in FIG. 4*b*.

FIG. 5 shows a further conversion element 4, wherein the variation in the degree of conversion and scattering is achieved by means of the truncated cone shape in a manner analogous to FIG. 4*a*. However, said conversion element 4 is also constructed from two conversion element parts 4.1, 4.2, namely a cone and a truncated cone shell. Said conversion element parts could have different conversion or scattering properties, which is not compulsory, however.

An electrode 50 composed of ITO is arranged between the conversion element parts 4.1, 4.2. Said electrode can be measured in a resistive manner (not illustrated in detail), which permits monitoring of the conversion element 4. If there is a failure or other damage, as a rule, the electrode 50 is also damaged, which can be detected metrologically. The pump radiation source 2 can then be switched off or dimmed, which reduces a photobiological risk.

Figure 6:
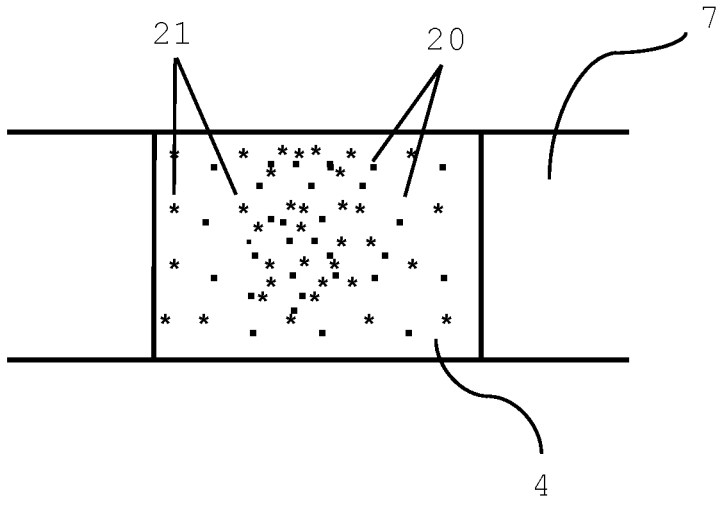
FIG. 6 shows a further possibility for configuring a conversion element according to various embodiments for an irradiation unit as per FIG. 1.

FIG. 6 shows a further conversion element with varying conversion and scattering properties. Analogously to the variant as per FIG. 2*a*, the conversion centers 20 and the scattering centers 21 are embedded in a matrix material, but, in contrast to FIG. 2*a*, not with a constant density. The conversion element 4 as per FIG. 6 is instead held in such a way that more conversion and scattering centers 20, 21 are provided in the matrix material centrally than at the edge outwardly. Consequently, the first portion 3*a* of the pump radiation 3 is converted and scattered to a greater extent than the second portion.

LIST OF REFERENCE SIGNS

| | |
|---|---|
| Irradiation unit | 1 |
| Pump radiation source | 2 |
| Pump radiation | 3 |
| First portion | 3a |
| Second portion | 3b |
| Conversion element | 4 |
| Incidence surface | 4a |
| Emission surface | 4b |
| Side walls | 4c |
| Conversion element parts | 4.1-4.5 |
| Conversion radiation | 5 |
| Optical unit | 6 |
| Carrier | 7 |
| Conversion centers | 20 |
| Scattering centers | 21 |
| Beam | 25 |
| Central segment | 25a |
| Edge segment | 25b |
| Central ray | 25.1 |
| Mask | 30 |
| Electrode | 50 |

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An irradiation unit, comprising:

a pump radiation source for the emission of pump radiation; and a conversion element for the at least partial conversion of the pump radiation to a conversion radiation;

wherein, during operation of the irradiation unit, the pump radiation is incident in the form of a beam from the pump radiation source on an incidence surface of the conversion element;

wherein a first portion of the pump radiation is incident on the conversion element in a central segment of the beam and a second portion of the pump radiation is incident on the conversion element in an edge segment of the beam surrounding the central segment; and wherein the conversion element is provided in such a way that a normalized degree of conversion and/or a normalized degree of scattering is lower for the second portion of the pump radiation than for the first portion of the pump radiation;

wherein the conversion element is provided with at least one of a higher density of conversion or scattering centers in a central region through which the central segment of the beam passes than in an edge region through which the edge segment of the beam passes;

wherein the conversion element is provided with an electrode embedded into the conversion element; and wherein the electrode is disposed between the central region of the conversion element and the edge region of the conversion element.

2. The irradiation unit of claim 1, wherein at least one of the normalized degree of conversion or the normalized degree of scattering of the conversion element for the second portion of the pump radiation in the beam decreases with a continuous profile toward the outside, that is to say in directions perpendicular away from a central ray of the beam.

3. The irradiation unit of claim 1, wherein a mixture of the conversion radiation and proportionally non-converted pump radiation is output as illumination light at an emission surface of the conversion element;

wherein the illumination light is output with a color locus that is constant over the emission surface.

4. The irradiation unit of claim 1, wherein the conversion element is operated in transmission, that is to say the incidence surface and an emission surface are located opposite one another;

wherein said two surfaces are of different sizes and only the central segment of the beam passes through the smaller of the two surfaces.

5. The irradiation unit of claim 4, wherein a ratio of the surface area of the smaller of the two surfaces to the surface area of the larger of the two surfaces is between 1:5 and 9:10.

6. The irradiation unit of claim 4, wherein the conversion element, regarded in sectional planes each containing a central ray of the beam, is trapezoidal.

7. The irradiation unit of claim 6, wherein the conversion element, regarded in sectional planes each containing a central ray of the beam, has the shape of an isosceles trapezoid.

8. The irradiation unit of claim 1, wherein the pump radiation fills the entire incidence surface of the conversion element.

9. The irradiation unit of claim 1, wherein the conversion element is thicker in a central region through which the central segment of the beam passes than in an edge region of the beam through which the edge segment of the beam passes.

10. The irradiation unit of claim 9, wherein the conversion element is operated in transmission, that is to say the incidence surface and an emission surface are located opposite one another;

wherein one of said two surfaces is planar and the other of said two surfaces is convexly curved.

11. The irradiation unit of claim 1, wherein the density of at least one of the conversion or scattering centers decreases in steps away from the central region toward the outside over the edge region, that is to say in directions perpendicular away from a central ray of the beam, and is thereby constant within a respective region.

12. The irradiation unit of claim 1, wherein the conversion element is arranged in a partly radiation-transmissive, partly radiation-scattering carrier, said carrier being disposed in at least partially surrounding relation to the conversion element in at least one direction transverse to a central ray of the beam.

13. The irradiation unit of claim 12, wherein a radiation-impermeable mask, which masks the beam, is arranged on a side surface of the carrier extending parallel to at least one of the incidence surface or an emission surface of the conversion element.

14. A method, comprising:

providing an irradiation unit, comprising:

a pump radiation source for the emission of pump radiation; and a conversion element for the at least partial conversion of the pump radiation to a conversion radiation;

wherein, during operation of the irradiation unit, the pump radiation is incident in the form of a beam from the pump radiation source on an incidence surface of the conversion element;

wherein a first portion of the pump radiation is incident on the conversion element in a central segment of the beam and a second portion of the pump radiation is incident on the conversion element in an edge segment of the beam surrounding the central segment; and wherein the conversion element is provided in such a way that a normalized degree of conversion and/or a normalized degree of scattering is lower for the second portion of the pump radiation than for the first portion of the pump radiation;

providing the conversion element with at least one of a higher density of conversion or scattering centers in a central region through which the central segment of the beam passes than in an edge region through which the edge segment of the beam passes;

specifically providing a mixture of the conversion radiation and proportionally non-converted pump radiation;

providing the conversion element with an electrode embedded into the conversion element; and disposing the electrode between the central region of the conversion element and the edge region of the conversion element.

15. The method of claim 14, wherein specifically providing a mixture of the conversion radiation and proportionally non-converted pump radiation comprises providing white light.

16. The irradiation unit of claim 1, wherein the electrode is transparent.

17. The method of claim 14, wherein the electrode is transparent.

* * * * *